US006425613B1

(12) United States Patent
Shen

(10) Patent No.: US 6,425,613 B1
(45) Date of Patent: Jul. 30, 2002

(54) DOOR LOCKSET

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 85 days.

(21) Appl. No.: 09/675,844

(22) Filed: Sep. 29, 2000

(51) Int. Cl.[7] ..... E05B 3/00

(52) U.S. Cl. ..... 292/348; 292/DIG. 60; 292/357

(58) Field of Search ..... 292/357, 358, 292/348, DIG. 53, DIG. 54, DIG. 60, 356, DIG. 64; 70/224, 452

(56) References Cited

U.S. PATENT DOCUMENTS 4,884,835 A * 12/1989 Smallegan et al. ..... 292/357
5,385,374 A * 1/1995 Fann et al. ..... 292/336.3
5,761,936 A * 6/1998 Katayama ..... 70/224
5,904,232 A * 5/1999 Shen ..... 192/69.62
5,941,108 A * 8/1999 Shen ..... 70/467
5,983,683 A * 11/1999 Shen ..... 70/224
6,101,856 A * 8/2000 Pelletier et al. ..... 70/472

* cited by examiner

*Primary Examiner*—Anthony Knight
*Assistant Examiner*—John B. Walsh
(74) *Attorney, Agent, or Firm*—Alan Kamrath; Rider, Bennett, Egan & Arundel, LLP

(57) ABSTRACT

A door lockset comprises a transmission assembly comprising a chassis with two through-holes, an outside handle assembly, and an inside handle assembly. The outside handle assembly comprises an outside handle, an outside rose, and an outside rose liner. The outside rose liner has at least two pairs of diametrically disposed positioning holes selectively aligned with the through-holes of the chassis. The outside rose liner further includes two engaging posts each having a screw hole. The inside handle assembly comprises an inside handle, an inside rose, and an inside rose liner. The inside rose liner includes two holes aligned with the screw holes of the engaging posts.

9 Claims, 5 Drawing Sheets

DOOR LOCKSET

BACKGROUND OF THE INVENTION

1. Field of the Invention

The present invention relates to a door lockset that can be mounted to doors with different locations for positioning holes.

2. Description of the Related Art

A door generally includes a p air of diametrically disposed positioning holes through which two bolts are extended. Namely, the bolts are extended through a pair of diametrically disposed holes in the inside rose liner, the pair of diametrically disposed positioning holes in the door, and screw holes in two engaging posts projected from the outside rose liner. Conventionally, the positioning holes in the door are arranged along a vertical line for use with a typical lockset; yet some door locksets require the positioning holes arranged along a line at an angle of 45° with the vertical line. As a result, a typical lockset cannot be mounted to a door with such positioning holes.

The present invention is intended to provide an improved lockset that mitigates and/or obviates the above problem.

SUMMARY OF THE INVENTION

It is an object of the present invention to provide an improved door lockset that has can be mounted to doors with different locations for positioning holes.

In accordance with the present invention, the door lockset comprises three pairs of diametrically positioning holes for use with doors having different locations for positioning holes.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
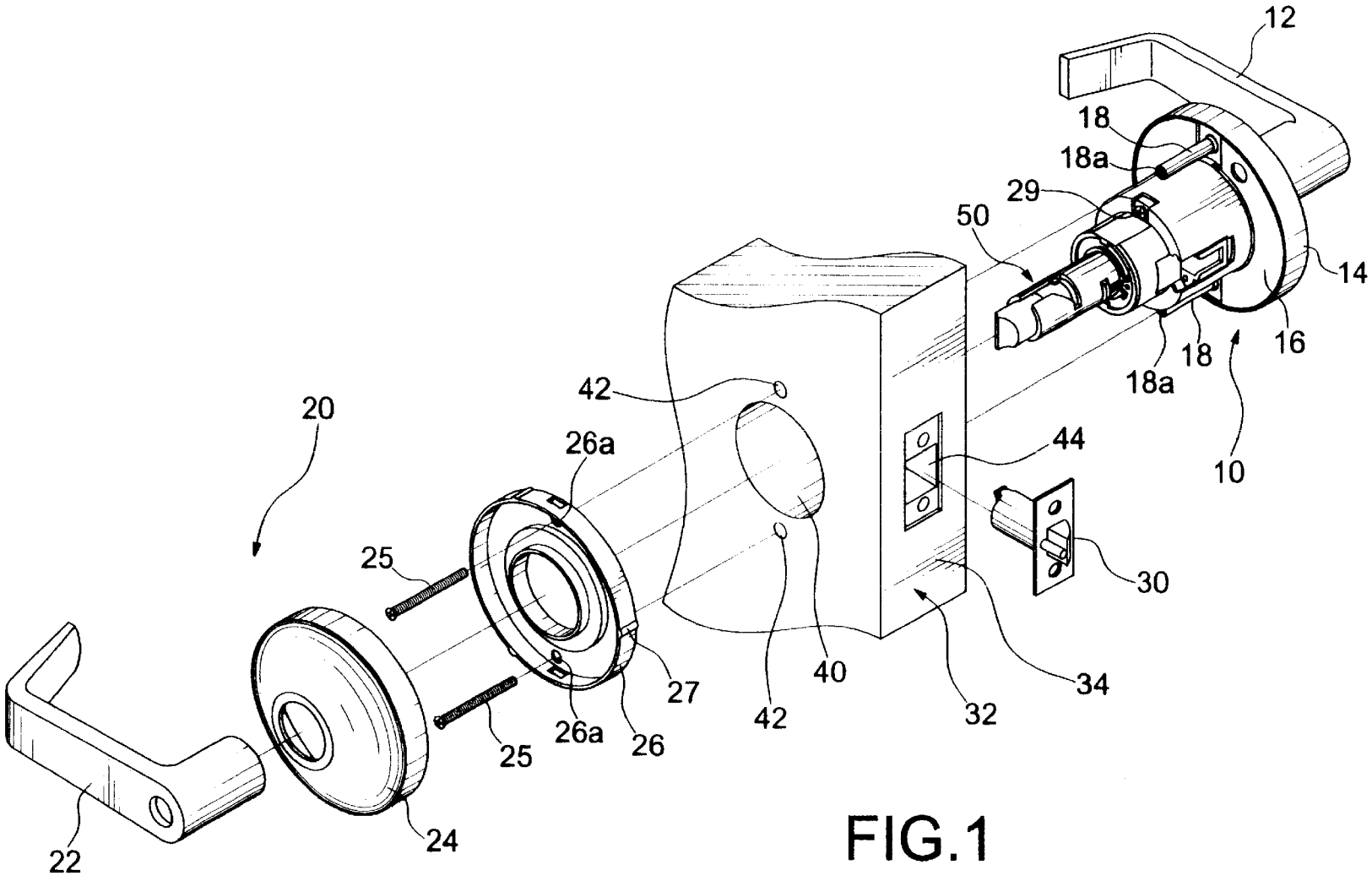
FIG. 1 is a perspective view of door lockset in accordance with the present invention.
Figure 2:
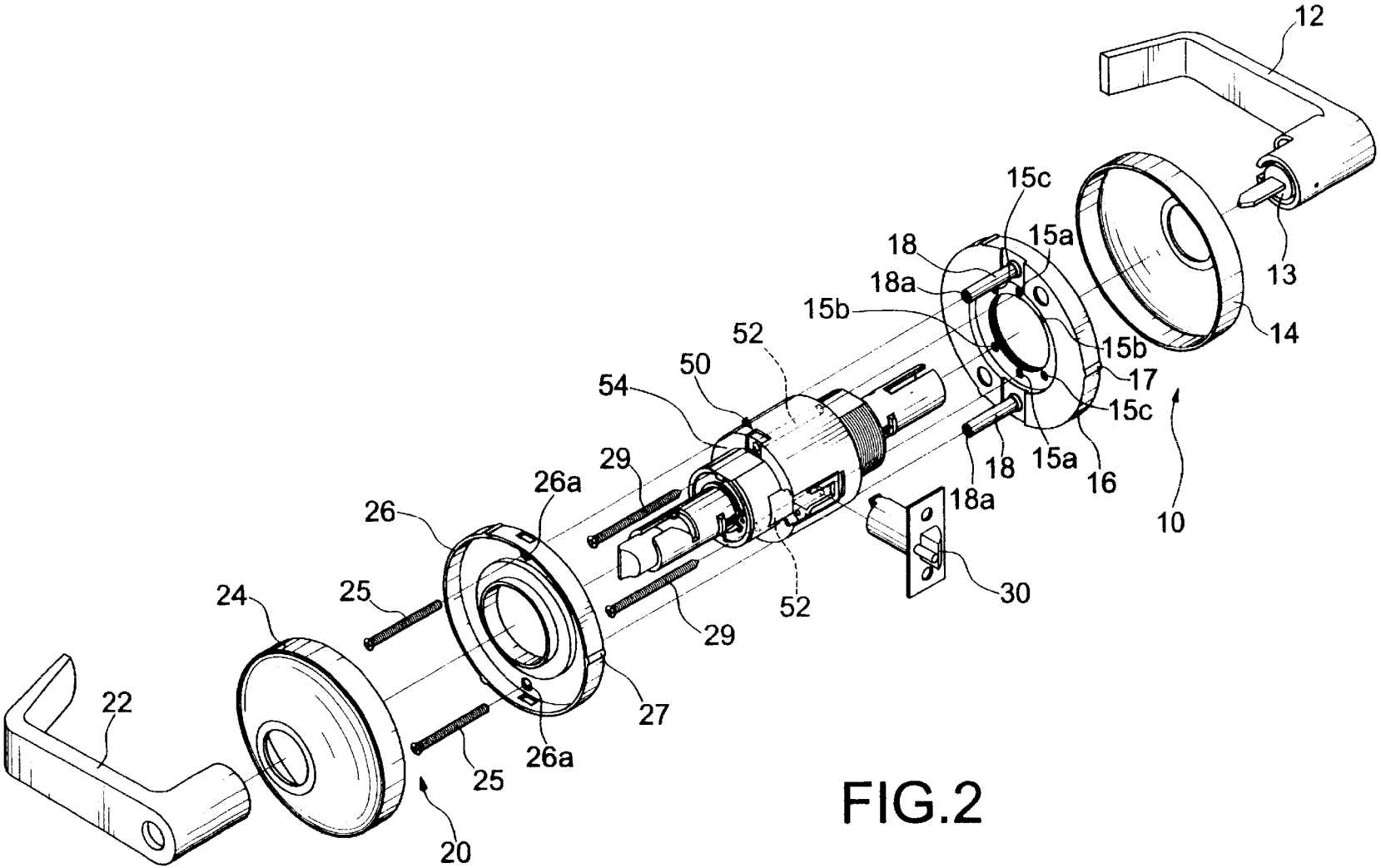
FIG. 2 is a further exploded perspective view of the door lockset in accordance with the present invention.
Figure 3:
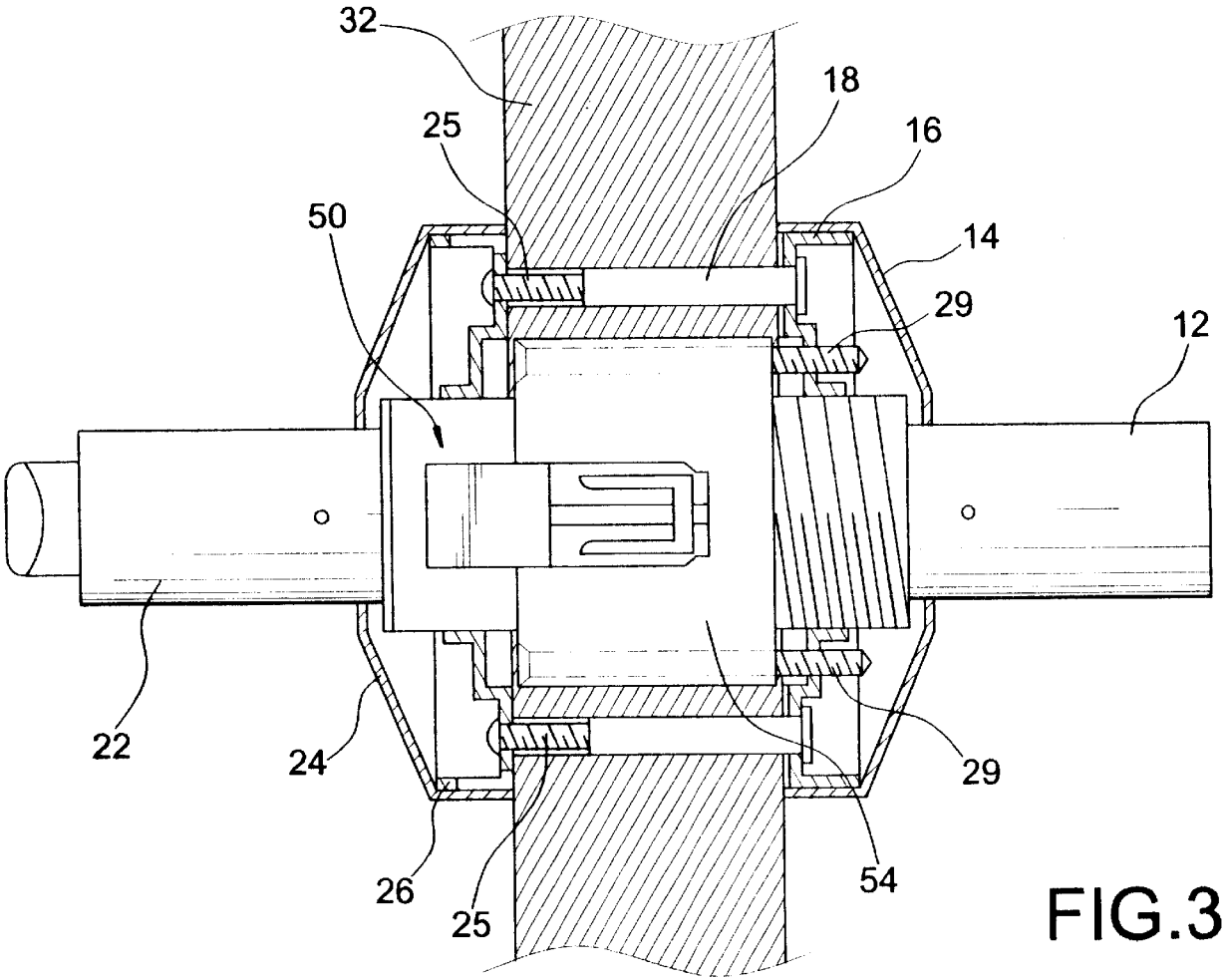
FIG. 3 is a schematic sectional view of the lockset in accordance with the present invention mounted to a door.
Figure 4:
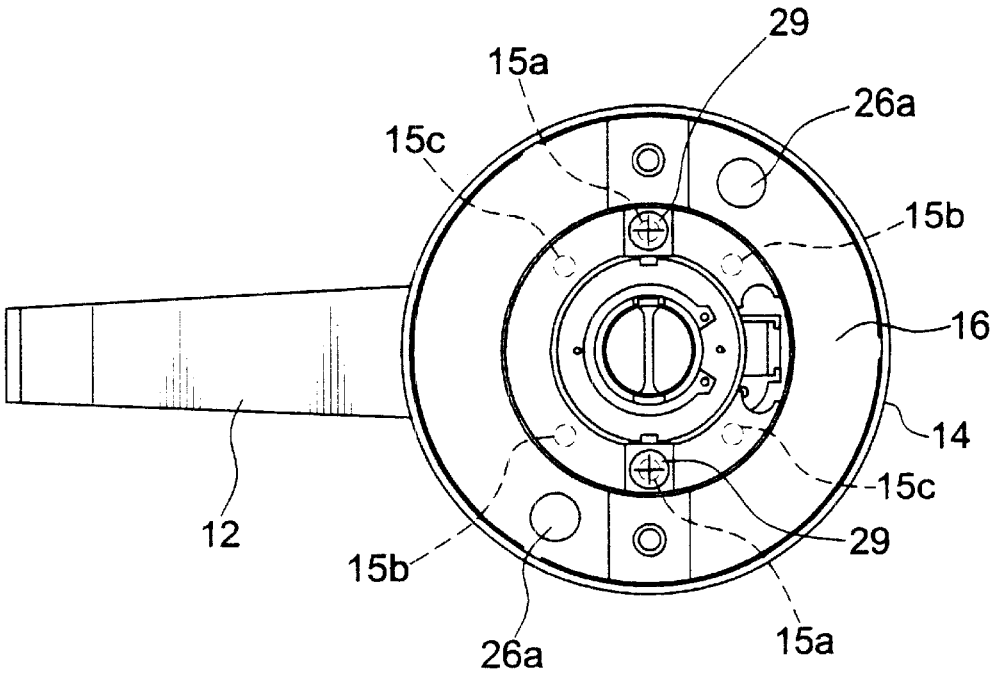
FIG. 4 is an elevational view of an outer handle assembly of the lockset.

Referring to FIGS. 1 through 6 and initially to FIGS. 1 through 3, a door lockset in accordance with the present invention generally includes an outside handle assembly 10, an insider handle assembly 20, a latch bolt 30, and a transmission assembly 50. The outside handle assembly 10 includes an outside handle 12 with a lock core 13 mounted therein, an outside rose 14, and an outside rose liner 16 having two engaging posts 18 projected therefrom. Each engaging post 18 has a screw hole 18*a*. The inside handle assembly 20 includes an inside handle 22, an inside rose 24, and an inside rose liner 26 having two positioning holes 26*a*. The transmission assembly 50 includes a chassis 54 having two through-holes 52.

Of more importance, the outside rose liner 16 includes a first pair of diametrically disposed positioning holes 15*a,* a second pair of diametrically disposed positioning holes 15*b,* and a third pair of diametrically disposed positioning holes 15*c,* best shown in FIG. 2. It is noted that the first pair of positioning holes 15*a* is arranged along a vertical line, the second pair of positioning holes 15*b* is arranged along a line at an angle of 45° (clockwise) with the vertical line, and the third pair of positioning holes 15*c* is arranged along a line at an angle of 45° (counterclockwise) with the vertical line.

As illustrated in FIG. 1, a door 32 generally includes a mounting hole 40 for receiving the transmission assembly 50 and a cavity 44 in an end face 34 thereof for receiving the latch bolt 30. Referring to FIGS. 1 through 4, when mounting of the lockset to a door 32 having a pair of vertically arranged holes 42 around the mounting hole 40, after mounting of the outer handle assembly 10, two fasteners (e.g., screws 29) are extended through the through-holes 52 in the chassis 54 and the first pair of positioning holes 15*a* of the outside rose liner 16, and two other fasteners (e.g., bolts 25) are extended through the holes 26*a* in the inside rose liner 26*a,* the holes 42 in the door 32, and the screw holes 18*a* of the engaging posts 18 of the outside rose liner 16.

Figure 6:
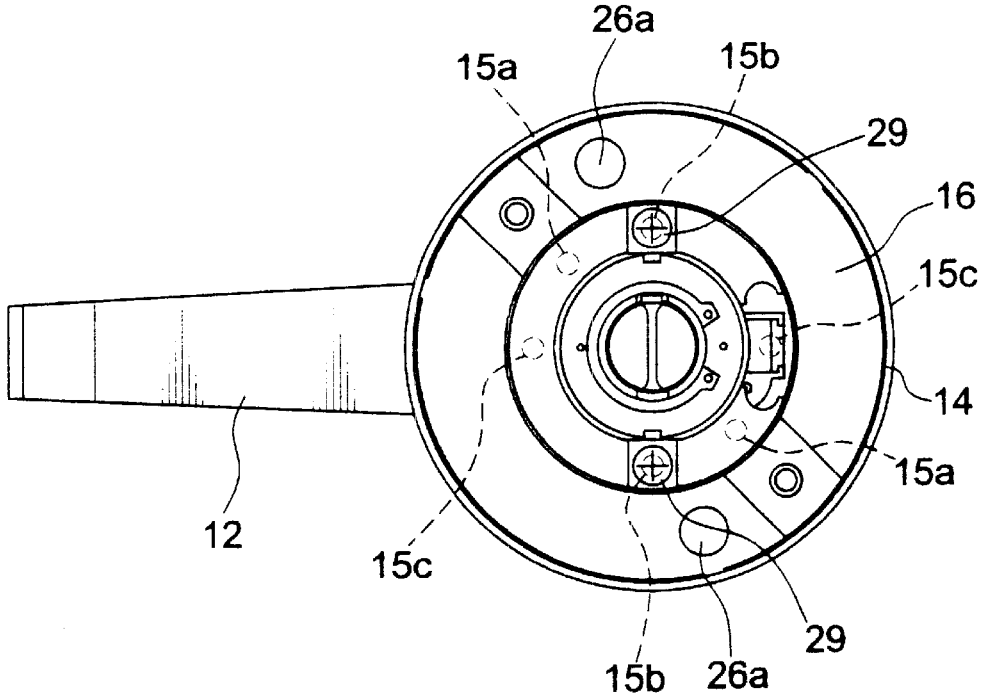
FIG. 6 is a view similar to FIG. 4, wherein the outer rose liner and the outer rose of the outer handle assembly are rotated through an angle in response to locations of the positioning holes of the door.
Figure 5:
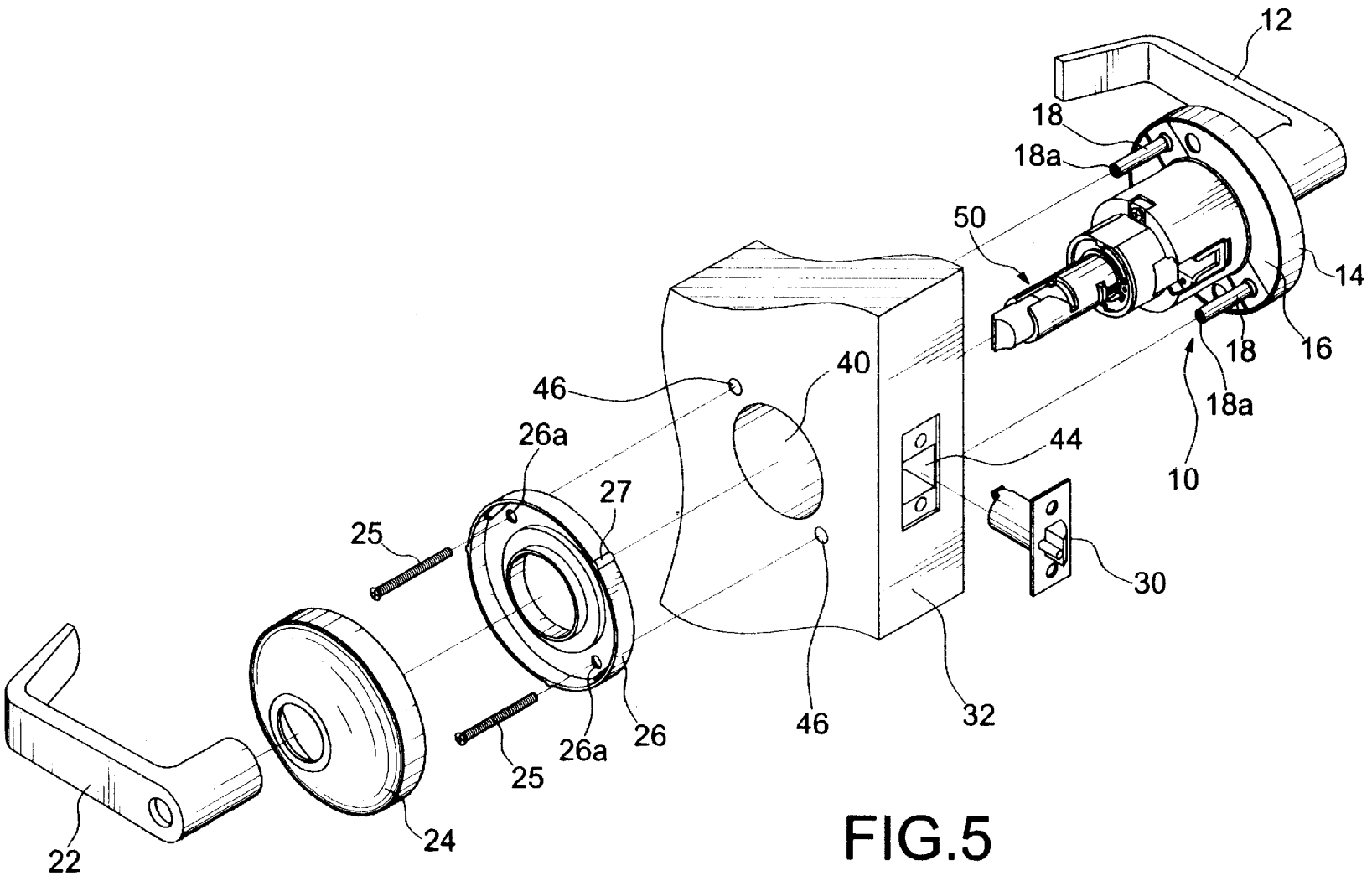
FIG. 5 is an exploded perspective view similar to FIG. 1, wherein the lockset is mounted to a door having a pair of positioning holes located at locations different from those of the door in FIG. 1.

Referring to FIGS. 5 and 6, when mounting the lockset to a door 32 having a pair of holes 46 that is arranged along a line at an angle of 45° (counterclockwise) with the vertical line passing through the holes 42 in FIG. 1, the outside rose liner 16 is turned counterclockwise through 45° until the second positioning holes 15*b* are respectively aligned with the throughholes holes 52 of the chassis 54. In addition, the inside rose liner 26 is also turned counterclockwise through 45° until the holes 26*a* are respectively aligned with the screw holes 18*a* of the engaging posts 18. Then, after mounting of the outer handle assembly 10, two screws 29 are extended through the through-holes 52 in the chassis 54 and the second pair of positioning holes 15*b* of the outside rose liner 16, and two bolts 25 are extended through the holes 26*a* in the inside rose liner 26*a,* the holes 42 in the door 32, and the screw holes 18*a* of the engaging posts 18 of the outside rose liner 16.

It is noted that the lockset in accordance with the present invention can be used with doors of the type having its positioning holes arranged along a line at an angle of 45° (clockwise) with the vertical line.

Provision of the outside rose liner 16 with three pairs of positioning holes 15*a*–15*c* allows the lockset to be used with different kinds of doors with differently arranged positioning holes.

Referring to FIG. 2, the outside rose liner 16 may include a plurality of annularly spaced ridges 17 on an outer periphery thereof such that the ridges 17 are engaged with an inner periphery of the outside rose 14 by press-fitting, thereby allowing joint rotation of the outside rose liner 16 and the outside rose 14. This allows easy adjustment of the angular position of the outside rose liner 16. Namely, the user may just turn the outside rose 14 to adjust angular position of the outside rose liner 16 in response to the locations of the positioning holes in the door 32 without the need of detaching the outside rose liner 16 from the outside rose 14. The inside rose liner 26 includes a plurality of annularly spaced ridges 27 on an outer periphery thereof such that the ridges 27 are engaged with an inner periphery of the inside rose 24 to prevent loosening of the inside rose 24.

Although the invention has been explained in relation to its preferred embodiment, it is to be understood that many other possible modifications and variations can be made without departing from the scope of the invention as hereinafter claimed.

What is claimed is:

1. A door lockset comprising:

a transmission assembly comprising a chassis with two through-holes;

an outside handle assembly comprising an outside handle, an outside rose, and an outside rose liner, the outside rose liner having at least two pairs of diametrically disposed positioning holes selectively aligned with the through-holes of the chassis, the outside rose liner further including two engaging posts each having a screw hole;

an inside handle assembly comprising an inside handle, an inside rose, and an inside rose liner, the inside rose liner including two holes aligned with the screw holes of the engaging posts; and two fasteners extending through the through-holes of the chassis and one pair of the first pair of positioning holes and the second pair of positioning holes.

2. The door lockset as claimed in claim 1, wherein the outside rose liner comprises at least one ridge formed on an outer periphery thereof for securely engaging with an inner periphery of the outside rose.

3. The door lockset as claimed in claim 1, wherein the inside rose liner comprises at least one ridge formed on an outer periphery thereof for securely engaging with an inner periphery of the inside rose.

4. The door lockset as claimed in claim 1, further comprising two further fasteners extending through the holes of the inside rose liner and the screw holes of the engaging posts.

5. A door lockset comprising:

a transmission assembly comprising a chassis with two through-holes;

an outside handle assembly comprising an outside handle, an outside rose, and an outside rose liner, the outside rose liner having a first pair of diametrically disposed positioning holes aligned along a first line, a second pair of diametrically disposed positioning holes aligned along a second line at a first angle with the first line, and a third pair of diametrically disposed positioning holes aligned along a third line at a second angle with the first line, one pair of the first pair of positioning holes, the second pair of positioning holes, and the third pair of positioning holes being aligned with the through-holes of the chassis, the outside rose liner further including two engaging posts each having a screw hole; and an inside handle assembly comprising an inside handle, an inside rose, and an inside rose liner, the inside rose liner including two holes aligned with the screw holes of the engaging posts.

6. The door lockset as claimed in claim 5, wherein the outside rose liner comprises at least one ridge formed on an outer periphery thereof for securely engaging with an inner periphery of the outside rose.

7. The door lockset as claimed in claim 5, wherein the inside rose liner comprises at least one ridge formed on an outer periphery thereof for securely engaging with an inner periphery of the inside rose.

8. The door lockset as claimed in claim 5, further comprising two fasteners extending through the through-holes of the chassis and one pair of the first pair of positioning holes, the second pair of positioning holes, and the third pair of positioning holes.

9. The door lockset as claimed in claim 8, further comprising two further fasteners extending through the holes of the inside rose liner and the screw holes of the engaging posts.

* * * * *